US009327862B2

(12) United States Patent
Barbieri et al.

(10) Patent No.: US 9,327,862 B2
(45) Date of Patent: May 3, 2016

(54) SEALED PACKAGE FOR POURABLE FOOD PRODUCTS AND PACKAGING MATERIAL FOR PRODUCING SEALED PACKAGES FOR POURABLE FOOD PRODUCTS

(75) Inventors: Marcello Barbieri, Modena (IT); Siegrid Putzer, Modena (IT); Alice Olivieri, Modena (IT); Stefania Pertusi, Sant'Agata Bolognese (IT); Joyce Nassif, Paris (FR)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 732 days.

(21) Appl. No.: 13/519,973

(22) PCT Filed: Apr. 6, 2011

(86) PCT No.: PCT/EP2011/055385

§ 371 (c)(1),
(2), (4) Date: Jun. 29, 2012

(87) PCT Pub. No.: WO2011/154173

PCT Pub. Date: Dec. 15, 2011

(65) Prior Publication Data

US 2012/0279182 A1 Nov. 8, 2012

(30) Foreign Application Priority Data

Jun. 7, 2010 (EP) ..... 10165116

(51) Int. Cl.
*B65D 5/42* (2006.01)
*B65B 43/10* (2006.01)
(Continued)

(52) U.S. Cl.
CPC ..... *B65D 5/064* (2013.01); *B65B 3/025* (2013.01); *B65B 9/067* (2013.01); *B65B 43/10* (2013.01); *B65B 43/24* (2013.01); *B65D 5/0209* (2013.01); *B65D 5/746* (2013.01)

(58) Field of Classification Search
CPC ..... B65B 3/025; B65B 9/067; B65B 9/207; B65B 43/10; B65B 43/24; B65D 5/064; B65D 5/0209; B65D 5/746
USPC ..... 53/450, 451, 456, 551, 558, 565
See application file for complete search history.

(56) References Cited

U.S. PATENT DOCUMENTS 3,369,727 A 2/1968 Wright
6,182,887 B1 2/2001 Ljunstrom et al.
(Continued)

FOREIGN PATENT DOCUMENTS

EP 0027350 A1 4/1981
EP 0277673 A1 8/1988
(Continued)

OTHER PUBLICATIONS

Office Action issued Jun. 17, 2014, by the Kazakhstan Patent Office in corresponding Kazakhstan Patent Application No. 2012/1667.1 and an English Translation of the Office Action (7 pages).
(Continued)

*Primary Examiner* — Thanh Truong
*Assistant Examiner* — Dianne Mitchell
(74) *Attorney, Agent, or Firm* — Buchanan Ingersoll & Roone PC

(57) ABSTRACT

A sealed package for pourable food products, comprising a quadrangular bottom panel with opposite first front edge and a second rear edge; a quadrangular top panel opposite to bottom panel and comprises a third front edge and a fourth rear edge; a front panel between first and third edges; and a rear panel between second and fourth edges; the distance between first and third edges is smaller than the distance between second and fourth edges; top panel angled with respect to a first plane defined by first and second edges; first and third edge define a theoretical reference plane; front panel comprises opposite fifth and sixth edges between first and second edges; at least one of fifth and sixth front edge extends at least partially on opposite side of theoretical plane with respect to rear panel; front panel comprises at least a first region on opposite side of theoretical plane.

29 Claims, 9 Drawing Sheets

(51) Int. Cl.

| | |
|---|---|
| ***B31B 49/02*** | (2006.01) |
| ***B65D 5/06*** | (2006.01) |
| ***B65B 3/02*** | (2006.01) |
| ***B65B 9/067*** | (2012.01) |
| ***B65B 43/24*** | (2006.01) |
| ***B65D 5/02*** | (2006.01) |
| ***B65D 5/74*** | (2006.01) |

(56) References Cited

U.S. PATENT DOCUMENTS

| | | | | |
|---|---|---|---|---|
| 6,357,203 | B1 | 3/2002 | Cicha et al. | |
| 7,017,796 | B2 * | 3/2006 | Ishikawa | 229/125.15 |
| 2004/0169066 | A1 | 9/2004 | Palm | |
| 2005/0211754 | A1 | 9/2005 | Fulcher | |
| 2006/0255110 | A1 * | 11/2006 | Kaneko | 229/125.14 |
| 2009/0145951 | A1 * | 6/2009 | Bone et al. | 229/4.5 |

FOREIGN PATENT DOCUMENTS

| | | | |
|---|---|---|---|
| EP | 1316508 | A1 | 6/2003 |
| EP | 1 332 969 | A1 | 8/2003 |
| RU | 2102295 | C1 | 1/1998 |
| RU | 2295480 | C2 | 3/2007 |
| WO | WO 2009/030910 | A2 | 3/2009 |
| WO | 2009/076422 | A2 | 6/2009 |

OTHER PUBLICATIONS

International Search Report (PCT/ISA/210) issued on Oct. 11, 2011, by the European Patent Office as the International Searching Authority for International Application No. PCT/EP2011/055385.

Written Opinion (PCT/ISA/237) issued on Oct. 11, 2011, by the European Patent Office as the International Searching Authority for International Application No. PCT/EP2011/055385.

Office Action issued by the Russian Patent Office on May 26, 2015 in corresponding Russian Application No. 2012155582, and English language translation of Office Action (12 pages).

Office Action issued by the European Patent Office on Oct. 19, 2015 in corresponding European Application No. 11712860.3-1708 (6 pages).

Decision to Grant issued by the Russian Patent Office on Feb. 17, 2016 in corresponding Russian Application No. 2012155582, and English language translation of Decision to Grant (12 pages).

* cited by examiner

SEALED PACKAGE FOR POURABLE FOOD PRODUCTS AND PACKAGING MATERIAL FOR PRODUCING SEALED PACKAGES FOR POURABLE FOOD PRODUCTS

TECHNICAL FIELD

The present invention relates to a sealed package for pourable food products.

The present invention also relates to a sheet packaging material for producing sealed packages for pourable food products.

BACKGROUND ART

As is known, many liquid or pourable food products, such as fruit juice, UHT (ultra-high-temperature treated) milk, wine, tomato sauce, etc., are sold in packages made of sterilized packaging material.

A typical example is the parallelepiped-shaped package for liquid or pourable food products known as Tetra Brik Aseptic (registered trademark), which is made by creasing and sealing laminated strip packaging material. The packaging material has a multilayer structure comprising a base layer, e.g. of paper, covered on both sides with layers of heat-seal plastic material, e.g. polyethylene. In the case of aseptic packages for long-storage products, such as UHT milk, the packaging material also comprises a layer of oxygen-barrier material, e.g. an aluminium foil, which is superimposed on a layer of heat-seal plastic material, and is in turn covered with another layer of heat-seal plastic material forming the inner face of the package eventually contacting the food product.

Packages of this sort are normally produced on fully automatic packaging machines, on which a continuous tube is formed from the web-fed packaging material; the web of packaging material is sterilized on the packaging machine, e.g. by applying a chemical sterilizing agent, such as a hydrogen peroxide solution, which, once sterilization is completed, is removed from the surfaces of the packaging material, e.g. evaporated by heating; the web so sterilized is then maintained in a closed, sterile environment, and is folded and sealed longitudinally to form a tube, which is fed vertically.

In order to complete the forming operations, the tube is filled with the sterilized or sterile-processed food product, and is sealed and subsequently cut along equally spaced cross sections.

More precisely, the tube is sealed longitudinally and transversally to its own axis.

Pillow packs are so obtained, which have a longitudinal seal and a pair of top and bottom transversal seals.

Alternatively, the packaging material may be cut into blanks, which are formed into packages on forming spindles, and the packages are then filled with the food product and sealed. One example of this type of package is the so-called "gable-top" package known by the trade name Tetra Rex (registered trademark).

A package is known which comprises:

- a rectangular bottom panel which is crossed by a bottom transversal seal;
- a rectangular top panel, which is crossed by a top transversal seal;
- a rear panel which extends between corresponding first edges of top and bottom panels;
- a front panel which is opposite to the rear panel and extends between corresponding second edges, opposite to first edges, of top and bottom panels; and

- a pair of lateral panels interposed between bottom and top panels, and between rear and front panels.

A longitudinal seal extends perpendicularly between the transversal seals and along the centerline of the rear panel.

In greater detail, rear and front panels are parallel to one another, lateral panels are parallel to one another, and lateral panels are orthogonal to both rear and front panels.

Furthermore, the top panel is slanted with respect to the bottom panel and is descending proceeding from the relative first edge to the relative second edge.

In other words, the distance between first edges of bottom and top panels is greater than the distance between second edges of such bottom and top panels.

As a consequence, the height of the rear panel is greater than the height of the front panel.

The top panel also comprises:

- a first area which accommodates an opening device and is bounded, on opposite sides, by the second edge and the transversal seal; and
- a second area which is bounded, on opposite sides, by the first edge and the transversal seal.

More precisely, the opening device substantially comprises a frame fitted to the first area of the top panel and a cap which is releasably coupled with the frame, so as to free a pouring opening of the food product, when unscrewed.

The above type of package is known under the name Tetra Brik Edge®. Its main characteristic is the slanted top panel, which brings two advantages: an angled top panel which improves the pourability, and a transversal seal, crossing the top panel, being offset towards the rear panel, leaving a greater area for placing a cap.

Such a known package could be uncomfortable to pick up, especially when it stands between several other similar packages on the shelf, or in a secondary package such as a cardboard box.

Furthermore, in correspondence with other carton packages, the reduced circulation of air between the packages, as a consequence of being tightly packed, could cause the formation of moisture onto such packages, especially if packed in a closed environment, such as a plastic wrap or a cardboard box, and even more so when subjected to humid weather conditions.

Due to the height of an opening device and to the inclination of the top panel, the opening device may protrude from the first area of the top panel beyond a hypothetical prolongation of the front panel as shown in FIG. 1. Since consumers today want bigger caps, for an improved drinking experience and improved pouring performance, this problem will only increase. Furthermore, newly developed one-step opening caps are higher than previous two-step opening caps, and this means that the caps stick out even more outside of the front panel. A one-step opening cap is a cap that only requires one action from the user, such as unscrewing the cap, in order to prepare the package for pouring or drinking.

A group of packages is often stored and transported in boxes as shown in FIG. 2*a*. In this condition, the front panel of a second package contacts the rear panel of a first package. Furthermore, the front panel of an initial package and the rear panel of a last package are in contact with respective inner walls of the box.

Furthermore, the opening device of the second package interferes with the rear panel of the first package and therefore exerts a pressure against this rear panel.

Accordingly, there is a risk that such pressure causes the opening devices to come off from the relative packages. The opening device could also cause a dent on the adjacent package, which causes an unwanted appearance and could make a customer reject the package. The dent could in worst case also affect the integrity of the package.

Furthermore, the interference between the opening device of the second package and the rear panel of the first package tends to slightly detach the front panel of the second package from the rear panel of the first package.

Accordingly, the rear panel of the last package and the front panel of the first package are forced against the walls of the box.

As a consequence, there is a risk of damaging the packages within the box or the shrink wrap, or even to cause damage to the secondary box or shrink wrap itself.

Finally, packages with opening devices applied thereon are normally transferred on a belt conveyor within the packaging plant.

In case that the conveyor is stopped or packages are grouped, a queue of packages with opening devices is formed. This happens relatively regularly in the packaging line.

In this situation, the packages are pushed against each other, and can become slightly angled or leaning with respect to the conveyor as a consequence of the interference between their opening devices and the rear panel of the adjacent package, as shown in FIG. 2*b*.

As a result, there is the risk that one or more of the packages fall over on the conveyor. This can cause a jam and the filling line must be stopped to fix the problem. It is also possible that some packages fall off the conveyor, due to this inclination, leading to waste of packaging material and product.

Furthermore, a need is felt within the industry to easily detected the fermentation of the pourable food product within the package and/or the leakage of air (or another gas) into the package.

EP-A-277673 discloses a sealed package comprising a quadrilateral top wall, a quadrilateral bottom wall, front and rear sidewalls and lateral sidewalls. The top wall is not provided with an opening device.

The joint portion between each two adjacent walls of the front, rear and lateral four side walls is formed with two ridgelines interconnecting the corresponding pair of corners of the top and the bottom walls.

The front wall extends between the front edges of top and bottom walls. The rear wall extends between the rear edges of top and bottom walls.

The two ridgelines are joined to each other at their upper and lower ends but are spaced apart from each other between these ends. The ridgelines extend smoothly as curved inwardly of the package to form a joint wall therebetween.

WO-A-2009/030910 discloses a package comprising a top and bottom walls, a front and a rear wall. And two lateral walls.

Top wall is sloped relative to sidewalls and to bottom wall. In a first embodiment, the front edge of the top wall—which coincides with the top edge of the front sidewall—is curved.

In a second embodiment, the package comprises a recess for receiving the nose of a consumer drinking directly from a spout. The recess is formed by providing a lenticular panel in the sheet packaging material from which package is formed.

DISCLOSURE OF INVENTION

It is therefore an object of the present invention to provide a sealed package for food product, which reduces at least one afore-mentioned drawback connected with the known packages and preserving, at the same time, the number of panels of the known packages.

According to the present invention, there is provided a sealed package for pourable food products, as claimed in claim 1.

Another object of the present invention is to provide a sheet packaging material for producing sealed packages of pourable food products, as claimed in claim 13.

Another object of the present invention is to provide a method for forming a sealed package for pourable food product, as claimed in claim 22.

BRIEF DESCRIPTION OF THE DRAWINGS

Two preferred, non-limiting embodiments of the present invention will be described by way of example with reference to the accompanying drawings, in which.

BEST MODE FOR CARRYING OUT THE INVENTION

Figure 3:
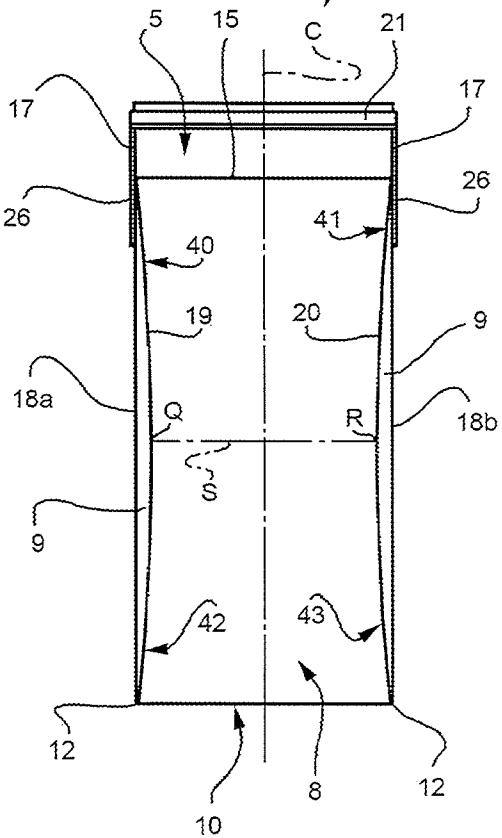
FIG. 3 shows a frontal view of a first embodiment of a sealed package for pourable food product, in accordance with the teachings of the present invention.

Number 1 in FIG. 3 indicates as a whole a sealed package for pourable food products, which is made of multilayer sheet packaging material 2 (FIG. 6) and may be fitted with a reclosable opening device 3 (shown in FIG. 7) preferably made of a plastic material.

Opening device 3 is applied to package 1 by conventional fastening systems, such as adhesives, or by microflame, electric-current-induction, ultrasound, laser, or other heat-sealing techniques.

With reference to FIG. 3, package 1 comprises:

- a quadrilateral (in the example shown, rectangular or square) top panel 5;
- a quadrilateral (in this case, rectangular or square) bottom panel 6, which is opposite to top panel 5;
- a flat rear panel 7, which extends between top panel 5 and bottom panel 6;
- a front panel 8, which extends between top panel 5 and bottom panel 6, and is opposite to rear panel 7; and
- two lateral panels 9 opposite to each other, and which extend between top panel 5 and bottom panel 6, and between rear and front panels 7, 8.

Lateral panels 9 extend each from front panel 8 to rear panel 7.

Front panel 8 and rear panel 7 are adjacent to both lateral panels 9.

Bottom panel 6 comprises two horizontal edges 10, 11 parallel to one another, and two horizontal edges 12 interposed between and orthogonal to edges 10, 11. Edges 12 are parallel to one another.

Panel 5 comprises two horizontal edges 15, 16 opposite to each other and parallel to one another. More precisely, horizontal edges 15, 16 are parallel to and arranged over edges 10, 11 respectively.

Edges 15, 16 are rectilinear.

Panel 5 also comprises two edges 17, which extend between edges 15, 16 and are parallel to one another.

Edges 17 are arranged over respective edges 12.

In particular, the distance between edges 11, 16 is greater than the distance between edges 10, 15.

In other words, the height of rear panel 7 is greater than front panel 8.

Edges 10, 11 and 12 define a plane; top panel 5 is slanted with respect to such a plane, and is descending, proceeding from edge 16 to edge 15.

The rear panel 7 extends between edges 11, 16 and comprises two vertical edges 18*a*, 18*b*, which are parallel to one another and extend between edges 11, 16.

Front panel 8 extends between edges 10, 15 and comprises two edges 19, 20, which extend between edges 10, 15.

Each lateral panel 9 is bounded by edge 12, 17, by a relative edge 18*a*; 18*b*, and by a relative edge 19; 20.

Edges 19, 20 are the only edges which extend between edges 10, 15.

Edges 19, 20 are distinct and separate from each other, i.e. they do not have any common point.

Edge 19 bounds both front panel 8 and one lateral wall 9.

Edge 20 bounds both front panel 8 and the other lateral wall 9.

Edges 10, 15 define a theoretical plane P, which is perpendicular to bottom panel 6, parallel to rear panel 7 and arranged, when package 1 is standing on the bottom panel 6, vertically.

Package 1 also comprises a top transversal sealing 21 and a bottom transversal sealing (not shown), which extends across respective top and bottom panels 5, 6.

Sealing band 21 divides top panel 5 into two portions 22, 23, one (22) of which, adjacent to front panel 8 and bounded by edge 15, defines an area for the potential application of opening device 3, while the other portion (23), adjacent to rear panel 7 and bounded by edge 16, comprises along the centerline, an end portion of a flat longitudinal sealing band 24 of package 1. More specifically, sealing band 24 extends perpendicularly between sealing band 21 and bottom sealing band, and substantially along the centerline of rear panel 7.

Sealing band 21 extends beyond top panel 5 of package 1 into respective flat, substantially triangular lateral portions 26 of packaging material folded coplanar with and onto respective lateral panels 9 as of top panel 5.

Sealing band 21 also forms, lengthwise, a flat top tab 30 projecting from portions 22, 23 and from lateral portions 26 and folded onto portions 23 and onto portions 26 along a bend line formed at the base of tab 30.

Advantageously, edges 19, 20 extend on the opposite side of plane P with respect to panel 7; the whole front panel 8 extends on the opposite side of plane P with respect to panel 7; and panels 9 are concave.

In greater detail, edges 19, 20 comprise, proceeding from edge 15 towards edge 10:

respective portions 40, 41 which extend at increasing distances from plane P; and respective portions 42, 43 which extend at decreasing distance from plane P.

In other words, edges 19, 20 extend outside of plane P with reference to panel 7.

Distances between edges 19, 20 and plane P are measured orthogonally to such plane P.

Portions 40, 42 join to one another at point Q while portions 41, 43 join to one another at point R (FIG. 3).

In other words, each edge 19, 20 comprises, proceeding from edge 15 to edge 10, a relative portion 40, 41 which extends at increasing distances from plane P and a relative portion 42, 43 which extend at decreasing distances from such plane P.

Portions 40, 41 converge towards one another, i.e. have a decreasing distance from each other, from edge 15 to a segment S, which connects points Q, R. Segment S is, in the embodiment shown, horizontal, and is arranged on the opposite side of edges 10, 15 relative to rear panel 7.

Points Q, R are arranged at the same distance from edge 10 and at the same distance from edge 15.

The distance of points Q, R, i.e. the length of segment S, is within +/−5% of the half of the distance between edges 10, 15.

Alternatively, the distance of points Q, R, i.e. the length of segment S, is within +/−5% of the average of the distance between edges 10, 15 and the distance between edges 11, 16.

Portions 42, 43 converge towards one another, i.e. have a decreasing distance from each other, from edge 10 towards segment S.

In other words, portions 40, 41 extend at increasing distances from plane P and at decreasing distances from one another, proceeding from edge 15 to segment S. Differently, portions 42, 43 extend at decreasing distance from plane P and at increasing distances from one another, proceeding from segment S to edge 10.

In this way, edges 19, 20 are arranged at the narrowest distance from one another at points Q, R.

As a consequence of the shape of edges 19, 20, lateral panels 9 are not flat but are defined by relative concave surfaces which at first converge towards one another and then diverge from one another, proceeding from relative edges 17 to relative edges 12.

Portions 40, 41, 42, 43 are, in the embodiment shown, curvilinear.

More precisely, edges 19, 20 are shaped, in the embodiment shown, as parabolic arcs.

Panel 8 is convex.

The maximum distance of panel 8 from plane P is reached at the mid-section of package 1, i.e. at a plane orthogonal of plane P and having the same distance from edges 15, 10.

Figure 1:
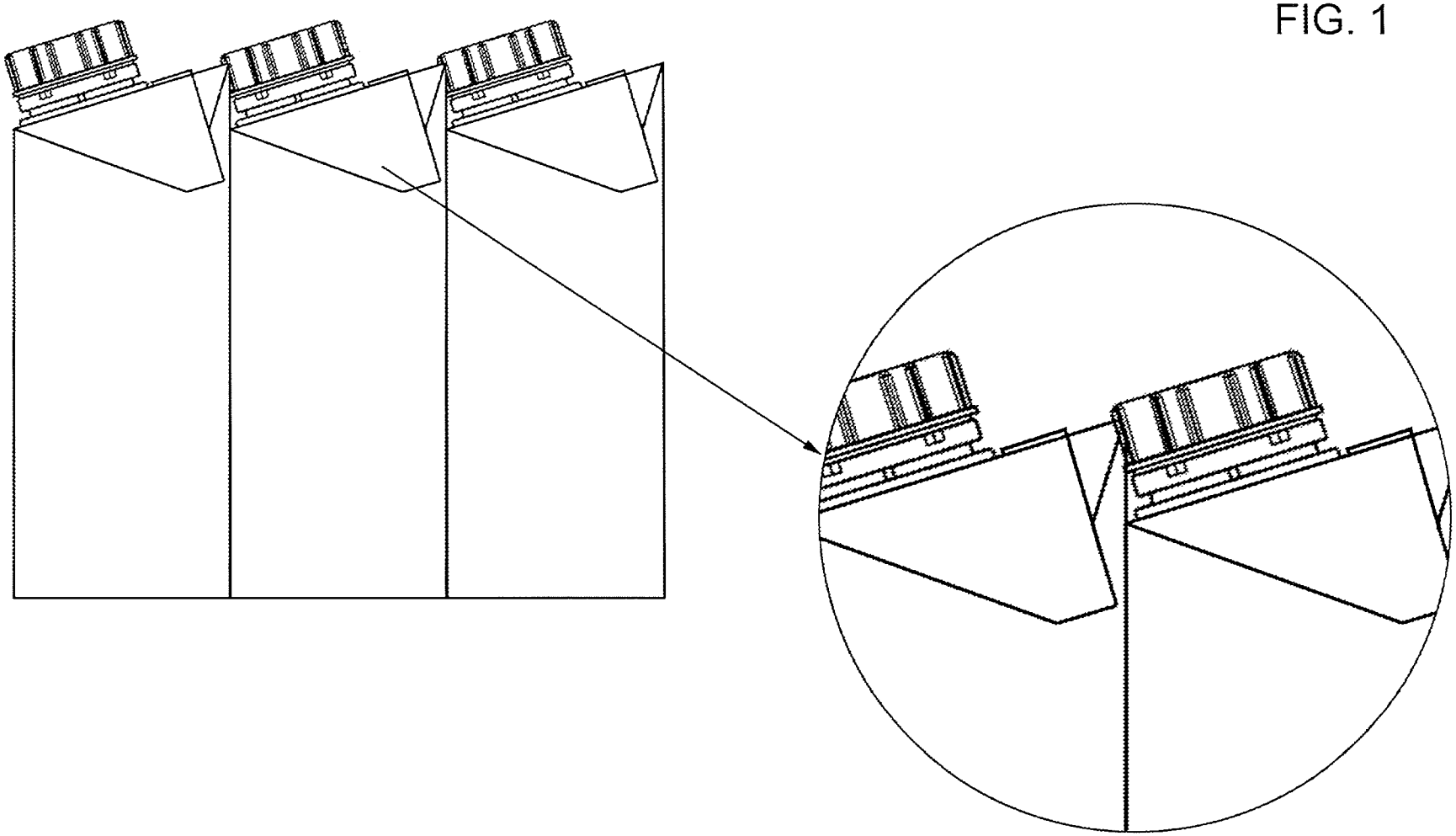
FIG. 1 shows a queue of known sealed packages which have been disclosed in the introductory part of the present description.
Figure 2A:
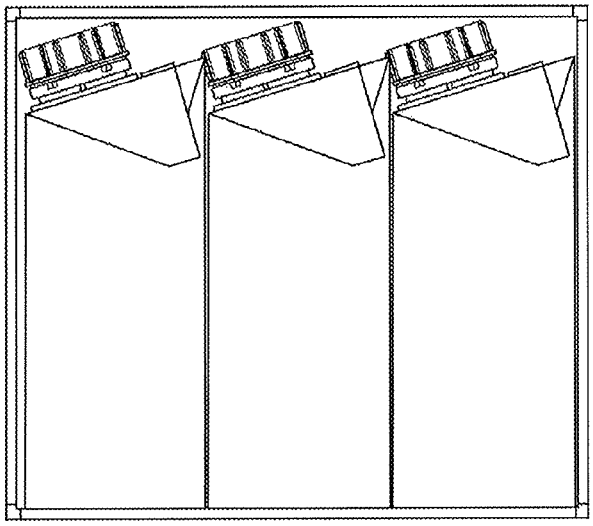
FIG. 2*a* shows the known sealed packages of FIG. 1 when accommodated within a box.
Figure 2B:
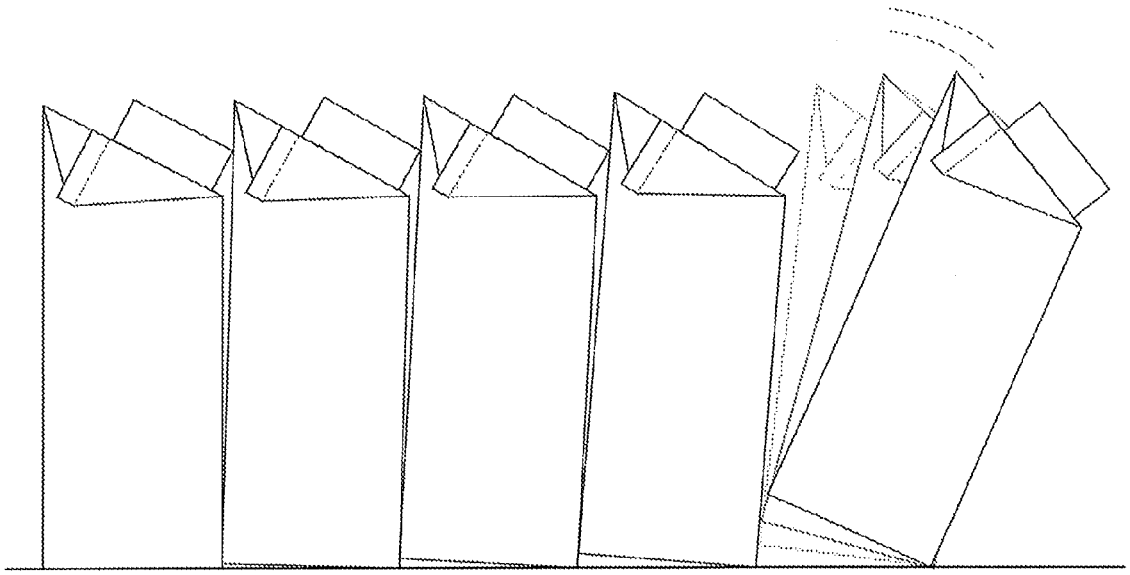
FIG. 2*b* shows the known packages in a queue, as they are falling off the conveyor.
Figure 5:
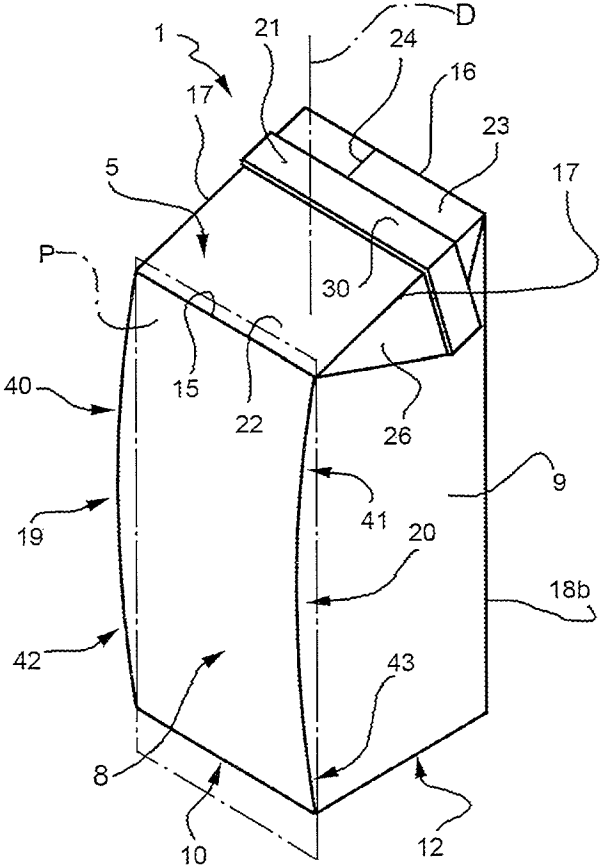
FIG. 5 shows a perspective view of the sealed package of FIGS. 3 and 4.
Figure 4:
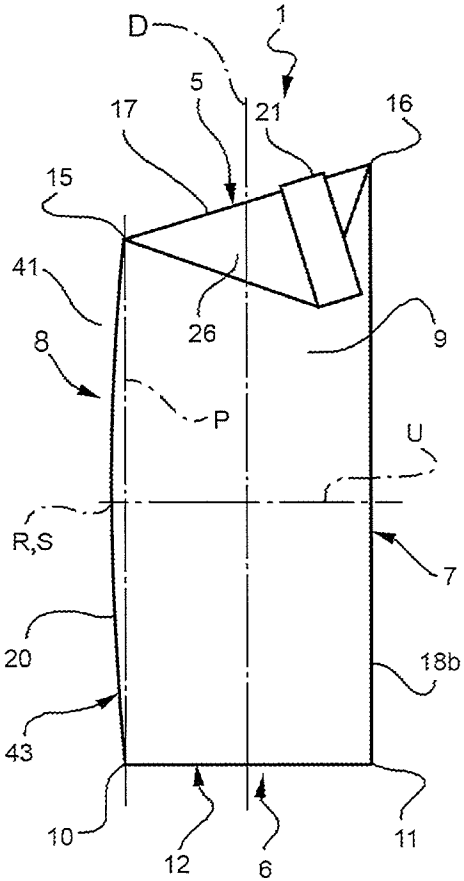
FIG. 4 shows a lateral view of the sealed package of FIG. 3.

Bottom panel 6 coincides with the projection of top panel 5 on a plane orthogonal to an axis D (FIGS. 4 and 5). More precisely, axis D joins the center points of panels 5, 6. Center points of panels 5, 6 coincide with respective intersection points of the diagonals of panels 5, 6.

Furthermore, the inclination angle of panel 5 relative to the plane defined by edges 10, 11 ranges between 15 and 20 degrees. In particular, such an inclination angle is 17 degrees.

Front panel 8 is symmetrical with respect to a curvilinear axis C which joins the middle-point of edge 15, the middle-point of segment S and the middle-point of edge 10. Axis C lies on and follows the front panel 8.

Axis C extends at increasing distance from plane P, proceeding from edge 15 to segment S; and extends at decreasing distances from plane P proceeding from segment S to edge 15.

Axis C has a similar conformation of edges 19, 20. In the embodiment shown, axis C is, therefore, shaped as a parabolic arc, although other curvatures are possible.

All sections of package 1 parallel to a plane U (FIG. 4) parallel to bottom panel 6, between edges 10 and 15, have the same perimeter or circumference, since the package 1 is formed from a cylindrical tube with constant diameter.

In top panel 5, the package 1 may have a removable portion (not shown in FIG. 6) that, in use, can be detached from packaging material 2 by an opening device 3 to free a pour opening by which to pour the food product from package 1.

Figure 7:
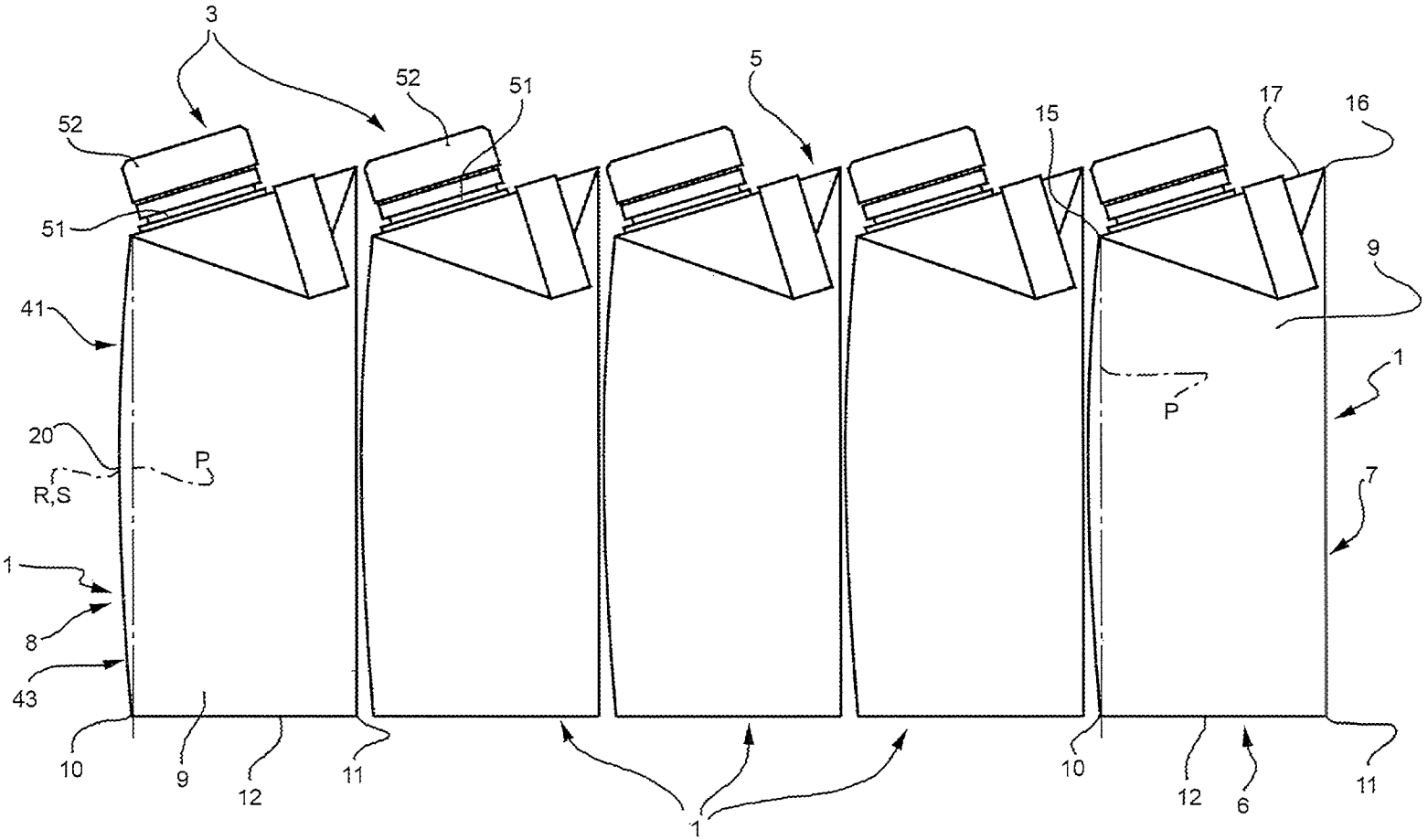
FIG. 7 shows a queue of sealed packages of the type shown in FIGS. 3 to 5.

Opening device 3 substantially comprises a frame 51 applied onto portion 22 of top panel 5, and a cap 52 screwed onto a neck defined by frame 51 (FIG. 7).

Packaging material 2 from which package 1 is made has a multilayer structure comprising a base layer, e.g. of paper, for stiffness, and a number of lamination layers covering both sides of base layer.

In the example shown, the lamination layers comprise a first layer of oxygen-barrier material, e.g. an aluminum foil, and a number of second layers of heat-seal plastic material covering both sides of both base layer and first layer. In other words, such solution comprises, in succession and from the side eventually forming the inside of package 1, a layer of heat-seal plastic material, a layer of barrier material, another layer of heat-seal plastic material, base layer, and another layer of heat-seal plastic material.

The inner layer of heat-seal plastic material contacting the food product, in use, may, for example, be made of strong, in particular, high-stretch, metallocene-catalyzed, low-linear-density (LLD) polyethylene.

Normally, layers of heat-seal plastic material are laminated on the base layer in a melted state, with successive cooling.

As a possible alternative, at least the inner layers of plastic material may be provided as prefabricated films, which are laminated on the base layer; this technique allows reducing any risk of formation of holes or cracks at or around the removable portion during the forming operations for producing sealed package 1.

Figure 6:
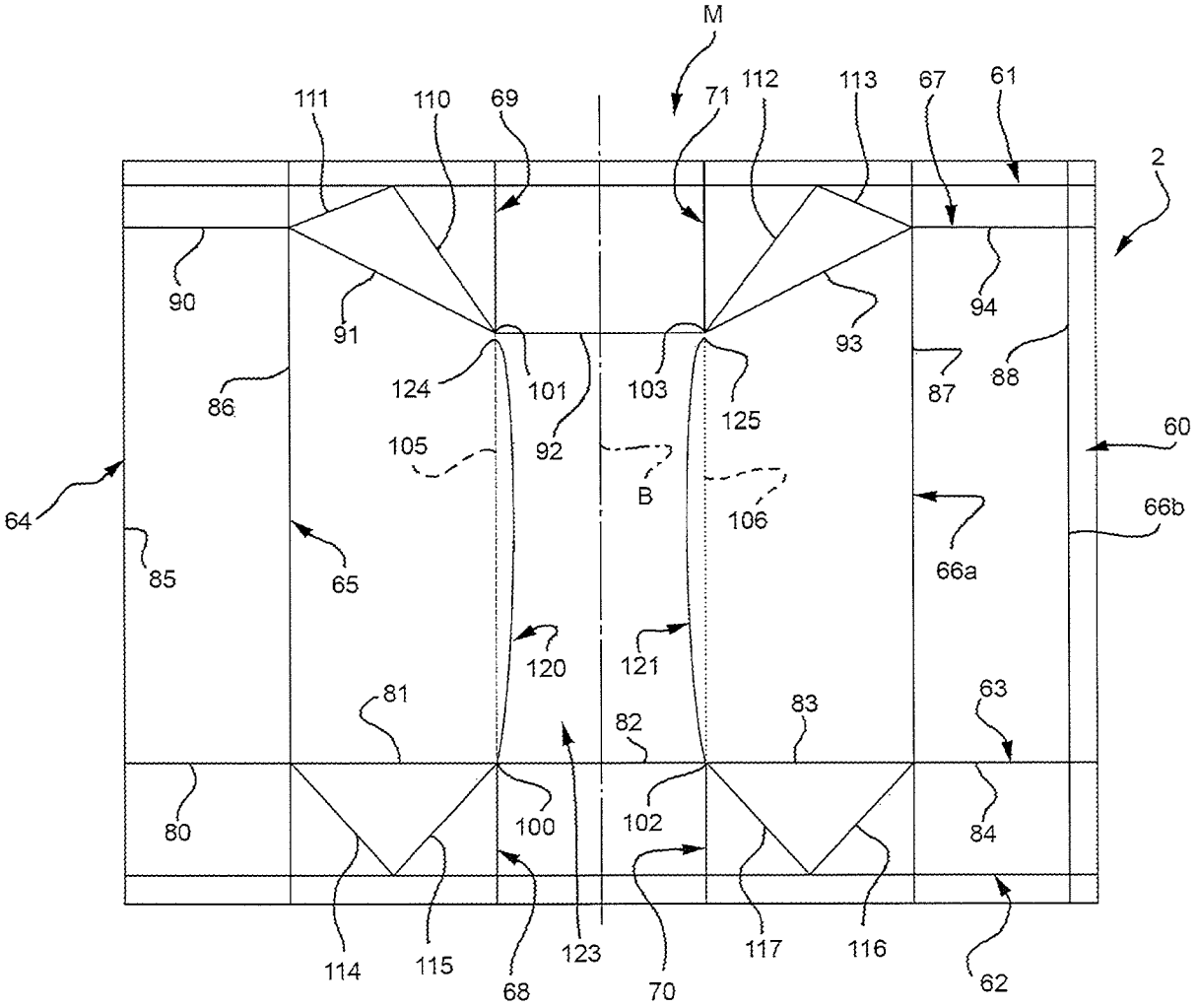
FIG. 6 shows a top plan view of a basic unit of a sheet packaging material by which to produce one package of the type shown in FIGS. 3 to 5.

The letter M in FIG. 6 indicates a basic unit of packaging material 2, by which to produce package 1, and which may be a precut blank, or a portion of a web of packaging material comprising a succession of units M.

In the first case, basic unit M is folded on a known crease spindle (not shown), is filled with the food product, and is sealed at the top and bottom to form package 1. In the second case, the web of packaging material 2, comprising a succession of basic units M, is:

- folded into a cylinder to form a vertical tube having constant circumference;
- filled continuously with the food product; and
- sealed transversely and cut into basic units M, which are then folded to form respective packages 1.

Basic unit M has a crease pattern 60, i.e. a number of crease lines defining respective fold lines, along which packaging material 2 is folded to form the finished package 1.

It is important to mention that the term crease lines is used in the present description lines along which basic unit M is folded to form a relative package 1, 1'. In particular, decorative lines are not crease line in the meaning of the present description.

Crease pattern 60 substantially comprises:

- a transversal crease line 63 for forming edges 10, 11, 12 of finished package 1;
- a piecewise transversal crease line 67 for forming edges 15, 16, 17 of finished package 1;
- a pair of transversal crease lines 61, 62 for allowing the folding of top seal 21 and of the bottom seal;
- a pair of longitudinal crease lines 65, 66*a* having respective main portions 86, 87 adapted to form respective edges 18*a*, 18*b* of finished package 1;
- a pair of longitudinal crease lines 68, 69 which are separated from and aligned to one another and comprise respectively inner end points 100, 101;
- a pair of longitudinal crease lines 70, 71 which are separated from and aligned to one another, are parallel to respective crease lines 68, 69, and comprise respectively inner end points 102, 103;
- a pair of crease lines 120, 121 for forming respectively edges 19, 20 of finished package 1; and
- an edge area 60 to be sealed on an opposite edge 64 of basic unit M to form a cylinder.

Crease lines 63, 61, 62 are parallel to each other and orthogonal to crease lines 65, 66*a*.

In particular, crease line 63 comprises a first segment 80 which extends between an edge 64 of crease pattern 60 and crease line 65;

- a second segment 81 which extends between crease line 65 and end point 100 of crease line 68;
- a third segment 82 which extends between end point 100 of line 68 and a top end point 102 of crease line 70;
- a fourth segment 83 which extends between end point 102 of line 70 and crease line 66*a;* and
- a fifth segment 84 which extends between crease line 66*a* and an edge area 66*b*.

Crease line 67 comprises:

- a first segment 90 parallel to first segment 80 of line 63 and which extends between edge 64 and crease line 65;
- a second segment 91 slanted with respect to second segment 81 of line 63 and which extends between crease line 65 and end point 101 of crease line 69;
- a third segment 92 parallel to third segment 82 of line 63 and which extends between end point 101 and end point 103 of crease line 71;
- a fourth segment 93 slanted with respect to third segment 83 of line 63 and which extends between end point 103 of crease line 71 and crease line 66a; and
- a fifth segment 94, which extends between crease line 66*a* and edge area 66*b*.

Furthermore, crease pattern 60 comprises:

- two pairs of crease lines 110, 111 and 112, 113 adapted to form respective top flaps 26 of finished package 1; and
- two pairs of crease lines 114, 115 and 116, 117 adapted to form bottom flaps (not shown in FIGS. 3 to 5) of finished package 1.

More precisely, the bottom flaps are folded onto panel 6 of finished package 1.

Crease line 110 (112; 115; 117) extends between end point 101 (103; 100; 102) and the midpoint of a segment of crease line 61 (61; 62; 62) interposed between crease lines 65, 69 (66*a*, 71; 65, 68; 66*a*, 70). Crease line 111 (113; 114; 116) extends between intersection point of crease lines 65, 67 (66*a*, 67; 65, 63; 66*a*, 63) and the midpoint of the segment of crease line 61 (61; 62; 62) interposed between crease line 65, 69 (66*a*, 71; 65, 68; 66*a*, 70).

End points 100, 101 are joined by a theoretical reference segment 105 (shown in a dotted-line in FIG. 6 but not present on basic unit M) and end points 102, 103 are joined by a theoretical reference segments 106 (shown in a dotted-line in FIG. 6 but not present on basic unit M).

Advantageously, crease lines 120, 121 extend within an area 123, rectangular in the embodiment shown, bounded by segment 82 of crease line 63, segment 92 of crease line 67 and by theoretical reference segments 105, 106.

In greater detail, crease lines 120, 121 comprise relative first ends which coincide with end points 100, 102, and second ends 124, 125, opposite to first ends, which are at a certain distance from relative end points 101, 103 of crease lines 69, 71.

Crease line 120 is the only crease line which originates from one (100) of end points 100, 101 and extends towards the other one (101) of end points 100, 101.

In the very same way, crease line 121 is the only crease line which originates from one (102) of end points 102, 103 and extends towards the other one (103) of end points 102, 103.

Crease lines 120, 121 are distinct and separate from each other, i.e. they do not have common points.

Crease lines 120, 121 at first converge towards one another and then diverge from one another, proceeding from end points 100, 102 of crease lines 68, 70 towards relative second ends 124, 125.

Crease lines 120, 121 extend at first at increasing distances from relative theoretical reference segments 105, 106 and then at decreasing distances from relative theoretical reference segments 105, 106, proceeding from end points 100, 102 of crease lines 68, 70 towards relative second ends 124, 125.

Crease lines 120, 121 extend also symmetrically with respect to an axis B, which joins the middle-points of segments 82, 92. Axis B is, in the embodiment shown, vertical.

Basic unit M has a constant width measured orthogonally to axis B. In this way, it could form a tube of packaging material from which packages 1, 1' are obtained after their folding.

Crease lines 120, 121 are curvilinear. More precisely, crease lines 120, 121 are, in the embodiment shown, shaped as parabolic arcs.

Number 1' in FIGS. 8 to 10 and 12 indicates a second embodiment of a sealed package in accordance with the present invention; sealed packages 1, 1' being similar to each other, the following description is limited to the differences between them, and using the same references, where possible, for identical or corresponding parts.

Figure 12:
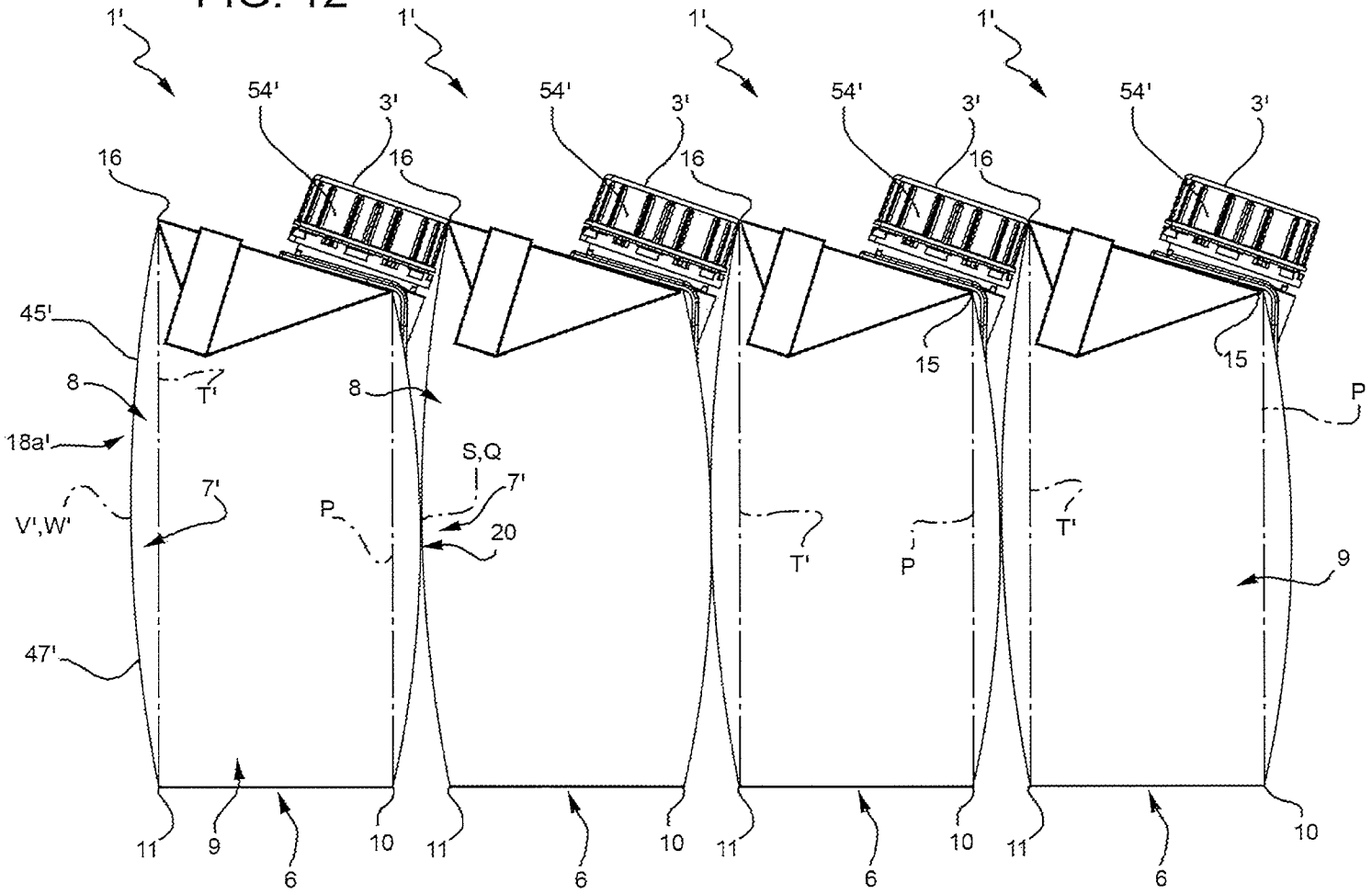
FIG. 12 shows a queue of sealed packages of the type shown in FIGS. 8 to 10.

Sealed package 1' differs from sealed package 1 in that edges 18*a*', 18*b*' extend on the opposite side of a theoretical reference plane T' defined by edges 11, 16, relative to panel 8; and in that the whole panel 7' extends, on the opposite side of plane T', relative to panel 8 (FIG. 12).

Panel 7' is, in particular, convex.

Edges 18*a*', 18*b*' are the only edges which extend between edges 11, 16.

Edges 18*a*', 18*b*' are distinct and separate from each other, i.e. they do not have any common point.

Edge 18*a*' bounds both rear wall 7 and one lateral wall 9.

Edge 18*b*' bounds both rear wall 7 and one lateral wall 9.

Plane T' is, in the embodiment shown, parallel to plane P.

In greater detail, edges 18*a*', 18*b*' comprise, proceeding from edge 16 towards edge 11 (FIG. 10):

- respective portions 45', 46' which extend at increasing distance from plane T' and converge to one another, i.e. have a decreasing distance from one another; and
- respective portions 47', 48' which extend at decreasing distance from plane T' and diverge from one another, i.e. have an increasing distance from one another.

The distance between edges 18*a*', 18*b*' and plane T' are measured orthogonally to such plane T'.

Portions 45', 47' and 46', 48' join to one another respectively at points W', Z' which are joined by a theoretical reference segment V'.

Segment V' is, in the embodiment shown, horizontal, is arranged on the opposite side of edges 11, 16 relative to panel 8, and is parallel and staggered relative to edges 11, 16.

Portions 45', 46', 47', 48' are, in the embodiment shown, curvilinear.

More precisely, edges 18*a*', 18*b*' are shaped, in the embodiment shown, as parabolic arcs. Other curvatures or shapes are possible of edges 18*a*', 18*b*'.

Rear panel 7' is symmetrical with respect to a curvilinear axis A' which joins the middle-point of edge 16, the middle-point of segment V' and the middle-point of edge 11.

Axis A' extends at increasing distances from plane T', proceeding from edge 16 to segment V'; and extends at decreasing distance from plane T', proceeding from segment V' to edge 16.

Axis A' has a similar conformation of edges 18*a*', 18*b*', and is, therefore, shaped as a parabolic arc in the embodiment shown.

The maximum distance of panel 7' from plane T' is reached at the mid-section of package 1', i.e. at a plane orthogonal of plane T' and having the same distance from edges 16, 11.

Figure 8:
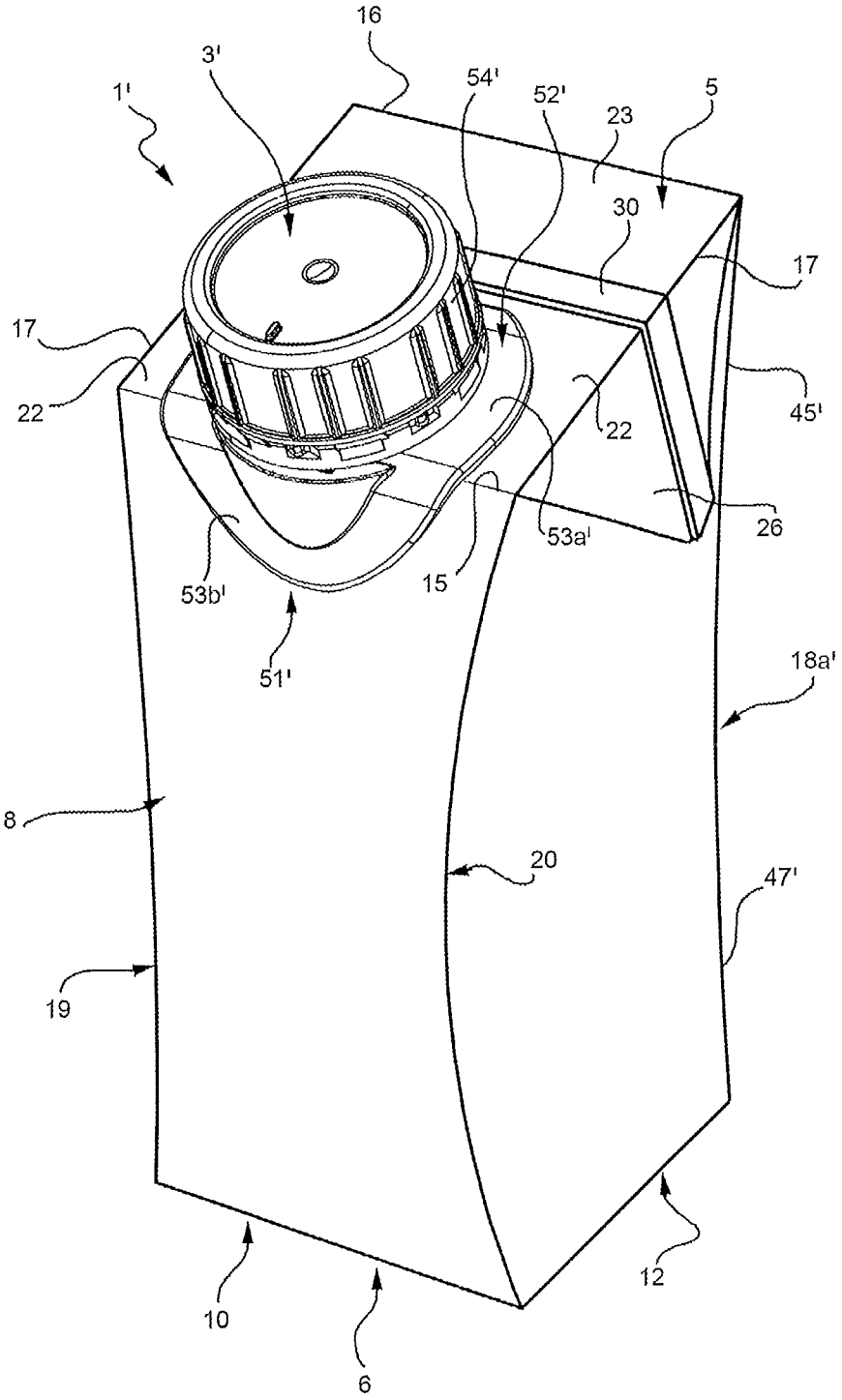
FIG. 8 shows a perspective view of a second embodiment of a sealed package for pourable food product.
Figure 10:
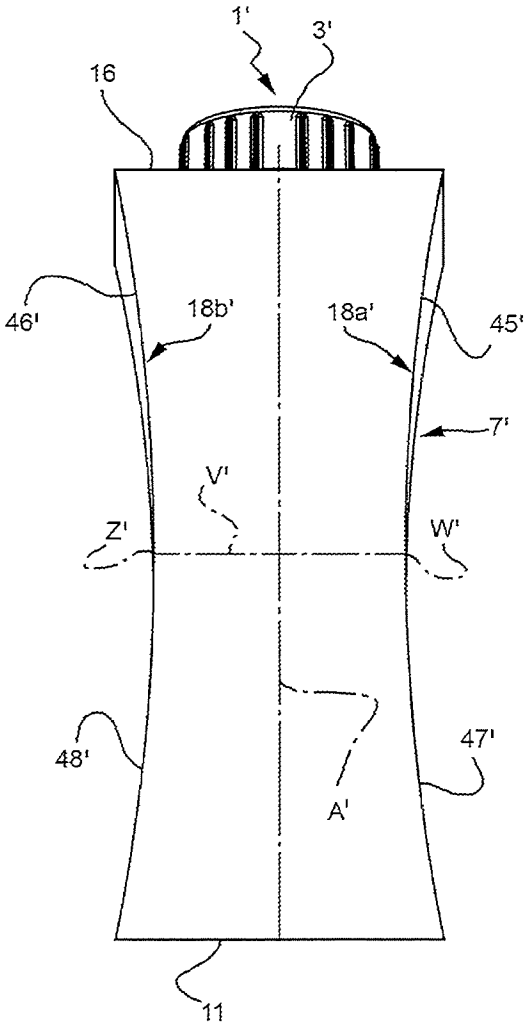
FIGS. 9 and 10 show a frontal and back view of the sealed package of FIG. 8.
Figure 9:
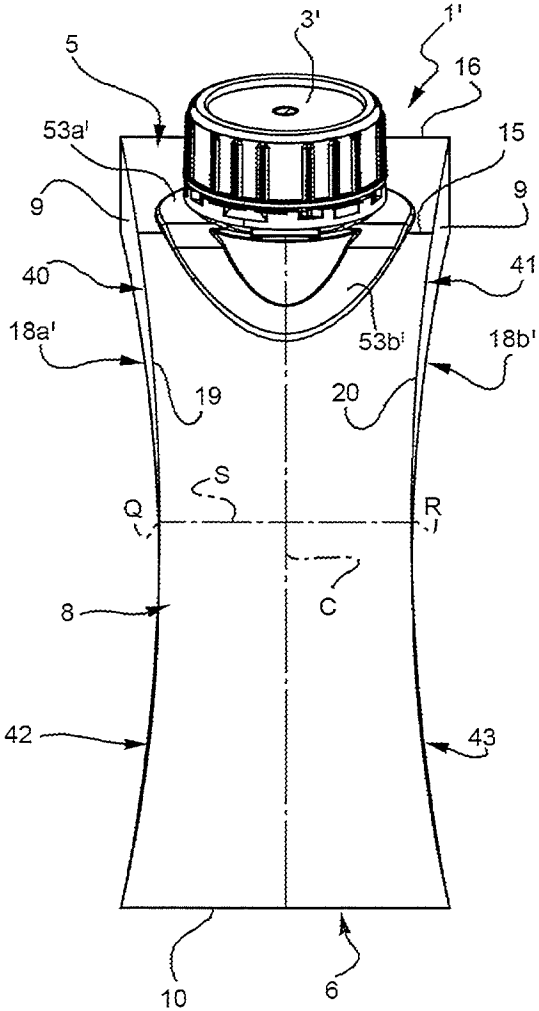

Package 1' also differs from package 1 in that opening device 3' substantially comprises a frame 51' which straddles edge 15 and comprises two fastening portions 53*a*', 53*b*' at a predetermined angle to each other (FIG. 8). Cap 52' is releasably fitted to a neck portion of frame 51'.

More precisely, portion 53*a*' is applied onto portion 22 of top panel 5 while portion 53*b*' is applied onto an area of front panel 8 adjacent to edge 15.

Figure 11:
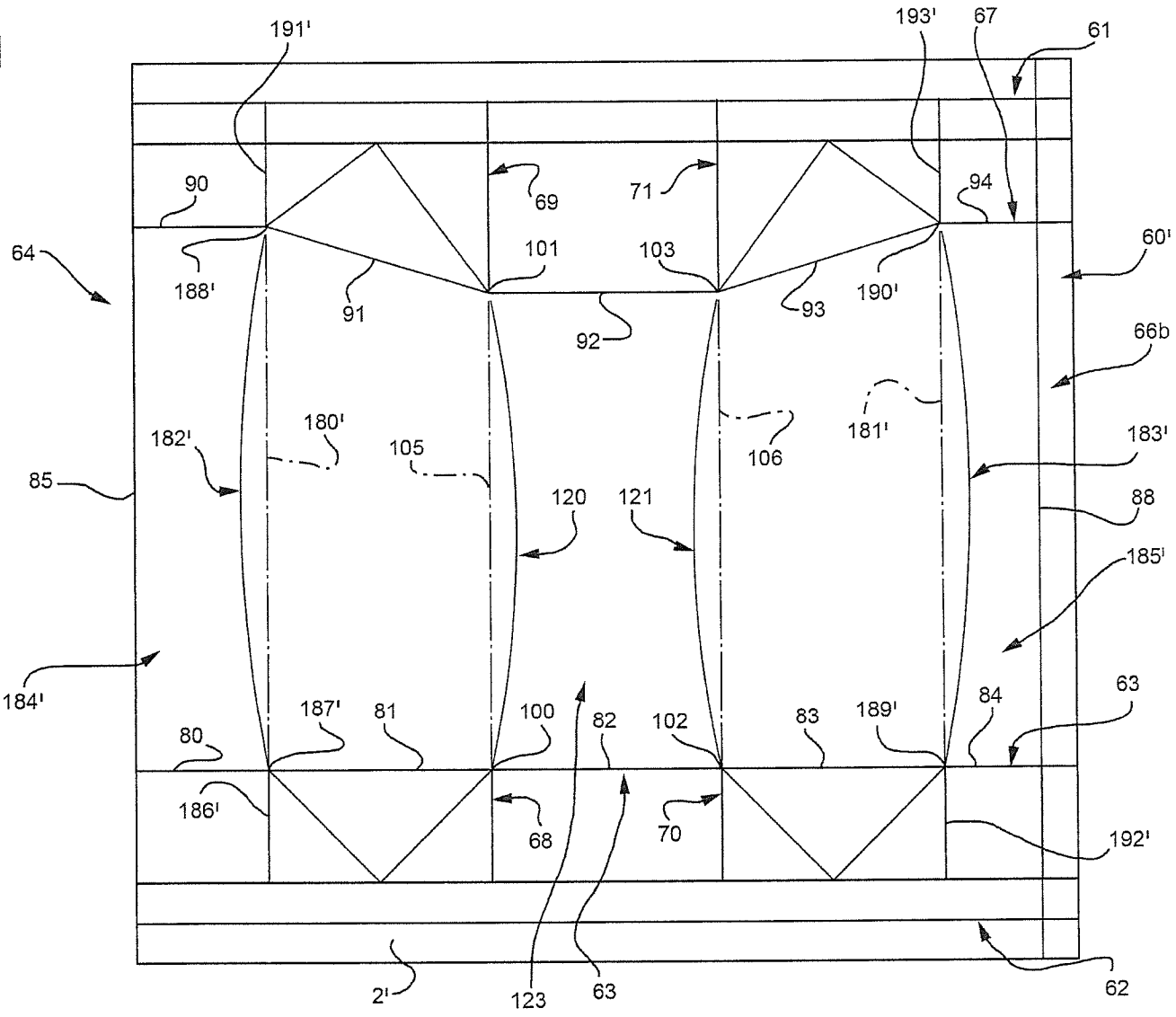
FIG. 11 shows a top plan view of a basic unit of sheet packaging material by which to produce one package of the type shown in FIGS. 7 to 10.

Letter M' in FIG. 11 indicates a second embodiment of a basic unit of packaging material 2', by which to produce package 1'; the basic units of packaging material 2, 2' for making the two different package embodiments 1, 1' are similar to each other, the following description is limited to the differences between them, and using the same references, where possible, for identical or corresponding parts.

Basic unit of packaging material 2' differs from basic unit of packaging material 2 in that crease pattern 60' does not comprise crease line 65. Furthermore, crease pattern 60' comprises, instead of crease line 65,:

- a segment 186' which extends from an end point 187' of segment 80 on the opposite side of crease line 67 and orthogonally to segment 80; and
- a segment 191' which extends from an end point 188' of segment 90 on the opposite side of crease line 63 and orthogonally to segment 90.

End point 187' is in common between segments 80, 186' as well as end point 188' is in common between segments 90, 191'.

Furthermore basic unit of packaging material 2' differs from basic unit of packaging material 2 in that it does not comprise crease line 66*a*.

Crease pattern 60' comprises, instead of crease line 66*a*:

- a segment 192' which extends from an end point 189' of segment 84 on the opposite side of crease line 67 and orthogonally to segment 84;
- a segment 193' which extends from an end point 190' of segment 93 on the opposite side of crease line 63 and orthogonally to segment 94.

End point 189' is in common between segments 84, 192' and end point 190' is in common between segments 94, 193'.

End points 187', 188' are joined by a theoretical reference segment 180' (shown in a dotted-line in FIG. 11 but not present on basic unit M) and end points 189', 190' are joined by a theoretical reference segment 181' (shown in a dotted-line in FIG. 11).

Crease pattern 60' finally comprises:

a crease line 182' which extends between end points 187', 188', and is adapted to define edge 18*a*' of finished package 1'; and a crease line 183' which extends between end points 189', 190' and is adapted to define edge 18b' of finished package 1'.

More precisely, crease line 182' originates from end point 187' and extends towards end point 188'. Differently, crease line 183' originates from end point 189' and extends towards end point 190'.

In greater detail, crease lines 182', 183' comprise relative first ends which coincide respectively with end points 187', 189'; and second ends which are at a certain distance from relative end points 188', 190'.

Advantageously, crease line 182' extends within an area 184' bounded by segments 80, 90, by a segment 85 of edge 64 interposed between segments 80, 90, and by theoretical reference segment 180'; and crease line 183' extends within an area 185' bounded by segments 84, 94, by a segment 88 along edge area 66*b*, and by theoretical reference segment 181'; crease line 182' is the only crease line which originates from one (187') of end points 187', 188' and extends towards the other one (188) of end points 187', 188'.

In the very same way, crease line 183' is the only crease line which originates from one (189') of end points 189', 190' and extends towards the other one (190) of end points 189', 190'.

Crease lines 182', 183' are distinct from each other, i.e. they do not have common points.

Areas 184', 185' are, in the embodiment shown, rectangular.

In greater detail, crease line 182' (183') at first converge towards segment 85 (88) and then diverge from such segment 85 (88), proceeding from end points 188' (190') towards end points 187' (189').

Crease line 182' (183') extends at first at increasing distances from theoretical reference segment 180' (181') and then at decreasing distance from theoretical reference segment 180' (181'), proceeding from end points 188' (190') towards end points 187' (189').

Crease lines 182', 183' are curvilinear and, in the embodiment shown, shaped as parabolic arcs.

As a consequence, crease pattern 60' comprises a first region and a second region adapted to define rear panel 7' of finished package 1', once that blank M' has been folded along segments 90, 94 and crease lines 181', 182', and edge 85 has been sealed to edge area 66b.

In particular, the first region is bounded by segments 80, 85, 90 and by crease line 182' while the second region is bounded by segments 84, 94, 88 and by crease line 183'.

Points Q, RE

The advantages of package 1, 1' and sheet packaging material 2, 2' and of the method of forming package 1, 1' according to the present invention will be clear from the above description.

In particular, package 1, 1' is easy to grip, in particular when it stands between several other similar packages 1, 1'.

As a matter of fact, when several packages 1, 1' are placed side-by-side, such as on a retailer shelf, the waist of the packages, caused by the central narrowing of the front panels 8 (and rear panels 7' if applicable), makes it easier to insert a finger on each side and pick out an individual package 1, 1'.

The presence of such a gap is due to the fact that front panel 8 extends on the opposite side of plane P with respect to rear panel 7, 7', Furthermore, due to the fact that each package 1, 1' is not in full contact with adjacent packages 1, 1', air is allowed to circulate between such packages 1, 1', so reducing the moisture surrounding packages 1, 1'.

As a result, packages 1, 1' are conserved in a particularly hygienic environment.

Furthermore, even when they are provided with an opening device 3, 3' which protrudes beyond rear panel 7, packages 1, 1' are prevented from being damaged when stored and/or transported in a plurality of rows within a box or when conveyed in a packaging plant.

As a consequence, when packages 1, 1' are arranged in rows, for example within a box to be stored and/or transported, even if front panel 8 of a second package 1, 1' contacts rear panel 7 of a first package 1, 1', cap 52, 52' of opening device 3, 3' of second package 1, 1' is substantially prevented from interfering with rear panel 7, 7' of first package 1, 1' (FIGS. 7 and 12).

Accordingly, the pressure exerted by cap 52, 52' of opening device 3, 3' against rear panel 7, 7' of a first package 1, 1' is dramatically reduced. As a consequence, also the risk that the cap 52, 52' of the opening device 3, 3' comes off as a result of the above-mentioned pressure is dramatically reduced.

Furthermore, rear panels 7, 7' of packages 1, 1' which contact the inner wall of the box are substantially prevented to exert a pressure against such inner wall.

Accordingly, also the risk of damaging packages 1, 1' within box is dramatically reduced.

In case that packages 1, 1' with opening device 3, 3' applied thereon form a queue on a conveyor, packages 1, 1' are substantially prevented from leaning with respect to one another.

In this way, even if a queue is particularly long, there is no risk that some packages 1, 1' fall over onto the conveyor.

Due to the fact that panels 9 are concave, package 1, 1' is particularly advantageous.

As a matter of fact, panels 9 create a space between packages 2 place side by side with respective panels 9 arranged side by side. This is effective in preventing mildew in shrink-wrapped multipack and/or in very difficult ambient conditions.

Furthermore, thanks to the presence of panels 9, it is much easier to detect if the pourable product has been fermented. In such a case, an internal pressure will press out panels 9 easily, making detection with available apparatus easily conducted. Furthermore, panels 9 could lose their concavity if air (or another gas) leaks into package 1, 1', through an untight sealing, or a micro-crack. In this case, this leakage may be easily detected and the package 1, 1' may be so discarded. In both the above cases, concave panels 9 create a small vacuum pressure inside package 1, 1', which is used for the above visualizations.

Finally, if edges 18*a*, 18*b* are curved, they work like an arch-type reinformencent and are, therefore, able to contrast a force exerted from an adjacent package 1'.

Package 1' reaches all the above-identified advantages, even when it is fitted with an opening device 3' which extends a considerable distance outside of front panel 8.

As a matter of fact, not only front panel 8 of package 1' extends on the opposite side of plane P with respect to rear panel 7', but also rear panel 7' of package 1' extends on the opposite side of plane T' with respect to front panel 8. In this way, as shown in FIG. 12, the gap available for cap 52' of opening device 3' substantially equals the sum of:

the distance between segment S and plane P of relative package 1'; and the distance between segment V' and plane T' of following package 1'.

It is important to mention that all the above-mentioned advantages are reached by the present invention without changing the quadrangular shape of package 1, 1', i.e. by a package 1, 1' which has two quadrangular bottom and top panel 6, 5 and four panels—front panel 8, rear panel 7, 7' and two panels 9—interposed therebetween.

Clearly, changes may be made to packaging material 2, 2' and the package 1, 1' as described and illustrated herein without, however, departing from the scope defined in the accompanying claims.

In particular, only the portion of front panel 8 adjacent to edge 15 could extend on the opposite side of plane P with respect to rear panel 7. In a completely analogous way, only the portion of rear panel 7' adjacent to edge 16 could extend on the opposite side of plane T' with respect front panel 8.

Furthermore, second ends 124, 125 may coincide with end points 101, 103. In this case, crease lines 120, 121 extend between relative end points 100, 102 and relative end points 101, 103.

In a completely analogous way, second ends of crease lines 182', 183' may coincide with end points 188', 190'.

Edges 18*a*, 18*b*, 19, 20 and crease lines 120, 121, 182', 183' may not be parabolic. For example, edges 18*a*, 18*b*, 19, 20 and crease lines 120, 121, 182', 183' may be shaped as a series of straight segments joined to one another and inclined with respect to one another.

Finally, the longitudinal seal of package 1, 1' may extend along a panel other than rear panel 7, 7'.

The invention claimed is:

1. A sealed package for pourable food products, comprising:

a quadrangular bottom panel which comprises a bottom front edge and a bottom rear edge opposite to one another;

a quadrangular top panel which is opposite to said bottom panel and comprises a top front edge and a top rear edge;

a front panel which extends between said bottom front edge and said top front edge;

a rear panel which extends between said bottom rear edge and said top rear edge;

two lateral panels opposite to each other, adjacent to said front and rear panel and extending each from said front panel to said rear panel;

the distance between said bottom front edge and said top front edge being smaller than the distance between said bottom rear edge and said top rear edge;

said top panel being angled with respect to a first theoretical reference plane defined by said bottom front edge and said bottom rear edge;

said bottom front edge and said top front edge defining a second theoretical reference plane;

said front panel comprising a first front lateral edge and a second front lateral edge which are opposite to one another and extend between said bottom front edge and said top front edge;

wherein at least one of said first front lateral edge and said second front lateral edge extends at least partially on the side of said second theoretical reference plane opposite said rear panel;

said front panel comprising at least a first region positioned on one side of said second theoretical reference plane such that said second theoretical reference plane is between said rear panel and said first region of said front panel;

said lateral panels being concave;

said front panel being curved outwardly of said second theoretical reference plane; and said sealed package being formed from a sealed tube of sterilized sheet packaging material.

2. The sealed package as claimed in claim 1, wherein said first region of said front panel is bounded by said top front edge.

3. The sealed package as claimed in claim 1, wherein a whole said front panel extends on the one side of said second theoretical reference plane.

4. The sealed package as claimed in claim 1, wherein said first front lateral edge and said second front lateral edge each comprise respective first portions which extend at increasing distances from said second theoretical reference plane, proceeding from said top front edge towards said bottom front edge.

5. The sealed package as claimed in claim 4, wherein said first front lateral edge and said second front lateral edge each further comprise respective second portions which are joined to corresponding first portions and originate, on the opposite side to said corresponding first portions, from said bottom front edge;

said second portions extending at increasing distances from said second theoretical reference plane, proceeding from said bottom front edge towards said first portions.

6. The sealed package as claimed in claim 5, wherein said first and second portions join at a first and a second point; said first and second points being arranged at the same distance from said bottom front edge and said top front edge and being connected by a segment;

said first portions converging towards one another from said top front edge towards said segment;

said second portions converging towards one another from said bottom front edge towards said segment.

7. The sealed package as claimed in claim 6, wherein said front panel extends symmetrically about an axis; said axis joining a middle point of said bottom front edge, a middle point of said segment, and a middle point of said top front edge.

8. The sealed package as claimed in claim 1, wherein said first front lateral edge and said second front lateral edge are the only edges extending between said bottom front edge and said top front edge;

said first front lateral edge and said second front lateral edge being separate and distinct from each other.

9. The sealed package as claimed in claim 1, wherein said bottom rear edge and said top rear edge defines a third theoretical reference plane;

said rear panel comprising a first rear lateral edge and a second rear lateral edge which are opposite to one another and extend between said bottom rear edge and said top rear edge;

at least one of said first rear lateral edge and said second rear lateral edge extending at least partially on an other side of said second theoretical reference plane such that said second theoretical reference plane is between said front panel and said at least one of said first rear lateral edge and said second rear lateral edge.

10. The sealed package as claimed in claim 9, wherein said first rear lateral edge and said second rear lateral edge are the only edges extending between said bottom rear edge and said top rear edge;

said first rear lateral edge and said second rear lateral edge being distinct and separate from each other.

11. The sealed package as claimed in claim 1, wherein all sections of said package measured parallel to said bottom panel and between said bottom front edge and said top front edge have a constant perimeter.

12. The sealed package as claimed in claim 1, wherein the angle between said first theoretical reference plane and said top panel ranges between 15 and 20 degrees.

13. The sealed package as claimed in claim 1, wherein said rear panel is flat or convex.

14. A sheet packaging material for producing a sealed package of a pourable food product, comprising:

at least one first crease line and one second crease line;

said first crease line comprising a first portion which is adapted to define a top front edge of a top panel of said sealed package;

said second crease line comprising a second portion which is adapted to define a bottom front edge of a bottom panel of said sealed package;

a third crease line which extends between respective third portions of said first and second crease lines;

a fourth crease line which extends between respective fourth portions of said first and second crease lines;

said first crease line further comprising a fifth portion interposed between said first and respective third portions, and a sixth portion interposed between respective said first and fourth portions;

said second crease line further comprising a seventh portion interposed between said second and said respective third portions, and an eighth portion interposed between said second and said respective fourth portions;

said third and fourth crease lines, and said third and fourth portions being adapted to bound a rear panel of said package, once said packaging material has been folded along said third and fourth crease lines, and along said third and fourth portions;

said third and fourth portions of said first crease line being adapted to define a top rear edge of said sealed package;

said third and fourth portions of said second crease line being adapted to define a bottom rear edge of said sealed package; said second, third, and fourth portions of said second crease line defining a first theoretical reference plane once said packaging material has been folded along said second, third, and fourth portions;

the distance between said third and fourth portions being greater than the distance between said first and second portions, so that the distance between said top rear edge and said bottom rear edge is greater than the distance between said top front edge and said bottom front edge of said sealed package;

a fifth and a sixth crease lines extending, at least partially, within a first area which is bounded by a first reference theoretical segment and a second reference theoretical segment, and by said first and second portions;

said first reference theoretical segment extending between a first end of said second portion and a second end of said first portion;

said second reference theoretical segment extending between a third end, opposite to said first end, of said second portion and a fourth end, opposite to said second end, of said first portion;

said fifth and sixth crease lines and said second and first portions being adapted to bound a front panel of said package, once said packaging material has been folded along said fifth and sixth crease lines and said second and first portions, said first and second portions defining a second theoretical reference plane once said packaging material has been folded along said first and second portions;

said fifth and seventh portions, said fifth crease line, and at least one part of said third crease line being adapted to define a first lateral concave panel extending from said front panel to said rear panel of said package, once said packaging material has been folded along said fifth crease line, said fifth and seventh portions and said at least one part of said third crease line;

said sixth and eighth portions, said sixth crease line and at least one part of said fourth crease line being adapted to define a second lateral concave panel extending from said front panel to said rear panel of said package, once said packaging material has been folded along said sixth crease line, said sixth and eighth portions and said at least one part of said fourth crease line;

said fifth and sixth crease lines and said second and first portions being configured so that the front panel bounded by said fifth and sixth crease lines and said second and first portions, once the packaging material has been folded along the fifth and sixth crease lines and said second and first portions, is a convex panel curved outwardly of the second theoretical reference plane; and said sheet packaging material being configured to be formed and sealed into a sterilized tube to produce said sealed package.

15. The sheet packaging material as claimed in claim 14, wherein said fifth crease line is the only one crease line originating from one of said first and second end and extending towards the other one of said first and second end;

said sixth crease line being the only one crease line originating from one of said third and fourth end and extending towards the other one of said third and fourth end.

16. The sheet packaging material as claimed in claim 15, wherein said third and fourth portions are each located on an opposite side of an axis, which joins a middle-point of said first portion and a middle-point of said second portion.

17. The sheet packaging material as claimed in claim 15, wherein said fifth and sixth crease lines wholly extend within said first area.

18. The sheet packaging material as claimed in claim 15, wherein said fifth and sixth crease lines at first converge towards one another and then diverge from one another, proceeding from said first portion towards said second portion.

19. The sheet packaging material as claimed in claim 15, wherein said fifth and sixth crease lines are symmetrical with respect to an axis, which joins a middle-point of said first portion and a middle-point of said second portion.

20. The sheet packaging material as claimed in claim 15, wherein:

said third crease line extends, at least partially, within a second area which is bounded by a third reference theoretical segment, by said third portions and by a first edge of said sheet packaging material;

said fourth crease line extends, at least partially, within a third area which is bounded by a fourth reference theoretical segment, by said fourth portions and by a second edge, opposite to said first edge, of said sheet packaging material;

said third reference theoretical segment extending between a fifth end of said third portion of said first crease line and a sixth end of said third portion of said second crease line;

said fourth reference theoretical segment extending between a seventh end of said fourth portion of said first crease line and an eighth end of said fourth portion of said second crease line.

21. The sheet packaging material as claimed in claim 20, wherein said third crease line is the only one crease line which originates from one of said sixth and fifth ends and extends towards the other one of said sixth and fifth ends;

said fourth crease line being the only one crease line which originates from one of said seventh and eighth ends and extend towards the other one of said seventh and eighth ends.

22. A method of forming a sealed package using a sheet packaging material as claimed in claim 14, the sealed package comprising: said bottom panel which is quadrangular and comprises said bottom front edge and a bottom rear edge opposite to another; said top panel which is quadrangular, is opposite to said bottom panel, and comprises said top front edge and said to rear edge; said front panel which extends between said bottom front edge and said top front edge; said rear panel which extends between said bottom rear edge and said top rear edge; and two lateral panels opposite to each other, adjacent to said front and rear panel and extending each from said front panel to said rear panel; the distance between said bottom front edge and said top front edge being smaller than the distance between said bottom rear edge and said top rear edge; said top panel being angled with respect to said first theoretical reference plane defined by said bottom front edge and said bottom rear edge; said bottom front edge and said top front edge defining said second theoretical reference plane; said front panel comprising a first front lateral edge and a second front lateral edge which are opposite to one another and extend between said bottom front edge and said top front edge; at least one of said first front lateral edge and said second front lateral edge extends at least partially on the side of said second theoretical reference plane opposite said rear panel; and said front panel comprising at least a first region positioned on one side of said second theoretical reference plane such that said second theoretical reference plane is between said rear panel and said first region of the front panel; the method comprising:

forming said rear panel by folding said sheet packaging material along said third and fourth crease lines, and along said third and fourth portions;

forming said front panel by folding said packaging material along said fifth and sixth crease lines and said first and second portions, said front panel being curved outwardly of said second theoretical reference plane;

forming a first said lateral panel by folding said packaging material along said fifth crease line, said fifth and seventh portions, and at least one part of said third crease line; and forming a second said lateral panel by folding said packaging material along said sixth crease line, said sixth and eighth portions and said at least one part of said fourth crease line.

23. The method as claimed in claim 22, comprising:

folding a web of packaging material comprising a succession of basic units formed each by a relative said sheet;

filling said web continuously with said pourable food product;

sealing said web and cut said web, so as to separate said basic units of said relative sheets; and folding said basic unit of said relative sheets to form corresponding said packages.

24. A sealed package for pourable food products, comprising:

a quadrangular bottom panel possessing a bottom front edge and a bottom rear edge opposite to one another;

a quadrangular top panel positioned opposite to the bottom panel and possessing a top front edge and a top rear edge;

a front panel extending between the bottom front edge and the top front edge;

a rear panel extending between the bottom rear edge and the top rear edge;

two lateral panels positioned opposite to each other and adjacent the front and rear panel, the two lateral panels each extending from the front panel to the rear panel;

the distance between the bottom front edge and the top front edge being smaller than the distance between the bottom rear edge and the top rear edge;

the top panel being angled with respect to a first theoretical reference plane defined by the bottom front edge and the bottom rear edge;

the bottom front edge and the top front edge defining a second theoretical reference plane;

the front panel possessing a first front lateral edge and a second front lateral edge which are opposite to one another and which each extend between the bottom front edge and the top front edge;

at least one of the first front lateral edge and the second front lateral edge extending at least partially on the side of the second theoretical reference plane opposite the rear panel;

the front panel possessing a region positioned on one side of the second theoretical reference plane such that the second theoretical reference plane is positioned between the rear panel and the region of the front panel;

the front panel being curved outwardly of the second theoretical reference plane; and the rear panel being flat.

25. A sealed package for pourable food products, comprising:

a quadrangular bottom panel possessing a bottom front edge and a bottom rear edge opposite to one another;

a quadrangular top panel positioned opposite to the bottom panel and possessing a top front edge and a top rear edge;

a front panel extending between the bottom front edge and the top front edge;

a rear panel extending between the bottom rear edge and the top rear edge;

two lateral panels positioned opposite to each other and adjacent the front and rear panel, the two lateral panels each extending from the front panel to the rear panel;

the distance between the bottom front edge and the top front edge being smaller than the distance between the bottom rear edge and the top rear edge;

the top panel being angled with respect to a first theoretical reference plane defined by the bottom front edge and the bottom rear edge;

the bottom front edge and the top front edge defining a second theoretical reference plane;

the front panel possessing a first front lateral edge and a second front lateral edge which are opposite to one another and which each extend between the bottom front edge and the top front edge;

at least one of the first front lateral edge and the second front lateral edge extending at least partially on the side of the second theoretical reference plane opposite the rear panel;

the front panel possessing a region positioned on one side of the second theoretical reference plane such that the second theoretical reference plane is positioned between the rear panel and the region of the front panel;

the first front lateral edge and the second front lateral edge extending between the bottom front edge and the top front edge and being the only edges extending between the bottom front edge and the top front edge;

the first front lateral edge and the second front lateral edge being separate from each other;

the front panel being bounded by the first front lateral edge and the second front lateral edge;

one of the two lateral panels being bounded by the first front lateral edge;

the other one of the two lateral panels being bounded by the second front lateral edge; and the sealed package being formed from a sealed tube of sterilized sheet packaging material.

26. A sealed package for pourable food products, comprising:

a quadrangular bottom panel possessing a bottom front edge and a bottom rear edge opposite to one another;

a quadrangular top panel positioned opposite to the bottom panel and possessing a top front edge and a top rear edge;

a front panel extending between the bottom front edge and the top front edge;

a rear panel extending between the bottom rear edge and the top rear edge;

two lateral panels positioned opposite to each other and adjacent the front and rear panel, the two lateral panels each extending from the front panel to the rear panel;

the distance between the bottom front edge and the top front edge being smaller than the distance between the bottom rear edge and the top rear edge;

the top panel being angled with respect to a first theoretical reference plane defined by the bottom front edge and the bottom rear edge;

the bottom front edge and the top front edge defining a second theoretical reference plane;

the front panel possessing a first front lateral edge and a second front lateral edge which are opposite to one another and which each extend between the bottom front edge and the top front edge;

at least one of the first front lateral edge and the second front lateral edge extending at least partially on the side of the second theoretical reference plane opposite the rear panel;

the front panel possessing a region positioned on one side of the second theoretical reference plane such that the second theoretical reference plane is positioned between the rear panel and the region of the front panel; and the sealed package possessing a circumference that is constant at all sections of the sealed package parallel to the bottom panel and located between the bottom front edge and the top front edge.

27. A sheet packaging material for producing a sealed package of a pourable food product, comprising:

at least one first crease line and one second crease line;

the first crease line comprising a first portion which is adapted to define a top front edge of a top panel of the sealed package;

the second crease line comprising a second portion which is adapted to define a bottom front edge of a bottom panel of the sealed package;

a third crease line which extends between respective third portions of the first and second crease lines;

a fourth crease line which extends between respective fourth portions of the first and second crease lines;

the first crease line further comprising a fifth portion interposed between the first and respective third portions, and a sixth portion interposed between respective the first and fourth portions;

the second crease line further comprising a seventh portion interposed between the second and the respective third portions, and an eighth portion interposed between the second and the respective fourth portions;

the third and fourth crease lines, and the third and fourth portions being adapted to bound a rear panel of the package, once the packaging material has been folded along the third and fourth crease lines, and along the third and fourth portions;

the third and fourth portions of the first crease line being adapted to define a top rear edge of the sealed package;

the third and fourth portions of the second crease line being adapted to define a bottom rear edge of the sealed package;

the distance between the third and between the fourth portions being greater than the distance between the first and second portions, so that the distance between the top rear edge and the bottom rear edge is greater than the distance between the top front edge and the bottom front edge of the sealed package;

a fifth and a sixth crease lines extending, at least partially, within a first area which is bounded by a first reference theoretical segment and a second reference theoretical segment, and by the first and second portions;

the first reference theoretical segment extending between a first end of the second portion and a second end of the first portion;

the second reference theoretical segment extending between a third end, opposite to the first end, of the second portion and a fourth end, opposite to the second end, of the first portion;

the fifth and sixth crease lines and the second and first portions being adapted to bound a front panel of the package, once the packaging material has been folded along the fifth and sixth crease lines and the second and first portions;

the first and second portions defining a theoretical reference plane, once the packaging material has been folded along the first and second portions;

the fifth and seventh portions, the fifth crease line, and at least one part of the third crease line being adapted to define a first lateral panel extending from the front panel to the rear panel of the package, once the packaging material has been folded along the fifth crease line, the fifth and seventh portions and the at least one part of the third crease line;

the sixth and eighth portions, the sixth crease line and at least one part of the fourth crease line being adapted to define a second lateral panel extending from the front panel to the rear panel of the package, once the packaging material has been folded along the sixth crease line, the sixth and eighth portions and the at least one part of the fourth crease line;

the fifth and sixth crease lines and the second and first portions being configured so that the front panel bounded by the fifth and sixth crease lines and the second and first portions, once the packaging material has been folded along the fifth and sixth crease lines and the second and first portions, is a convex panel curved outwardly of the theoretical reference plane; and the third and fourth crease lines and the third and fourth portions being configured so that the rear panel bounded by the third and fourth crease lines and the third and fourth portions, once the packaging material has been folded along the third and fourth crease lines and the third and fourth portions, is a flat panel.

28. A sheet packaging material for producing a sealed package of a pourable food product, comprising:

at least one first crease line and one second crease line;

the first crease line comprising a first portion which is adapted to define a top front edge of a top panel of the sealed package;

the second crease line comprising a second portion which is adapted to define a bottom front edge of a bottom panel of the sealed package;

a third crease line which extends between respective third portions of the first and second crease lines;

a fourth crease line which extends between respective fourth portions of the first and second crease lines;

the first crease line further comprising a fifth portion interposed between the first and respective third portions, and a sixth portion interposed between respective the first and fourth portions;

the second crease line further comprising a seventh portion interposed between the second and the respective third portions, and an eighth portion interposed between the second and the respective fourth portions;

the third and fourth crease lines, and the third and fourth portions being adapted to bound a rear panel of the package, once the packaging material has been folded along the third and fourth crease lines, and along the third and fourth portions;

the third and fourth portions of the first crease line being adapted to define a top rear edge of the sealed package;

the third and fourth portions of the second crease line being adapted to define a bottom rear edge of the sealed package;

the distance between the third and between the fourth portions being greater than the distance between the first and second portions, so that the distance between the top rear edge and the bottom rear edge is greater than the distance between the top front edge and the bottom front edge of the sealed package;

a fifth and a sixth crease lines extending, at least partially, within a first area which is bounded by a first and a second reference theoretical segment, and by the first and second portions;

the first reference theoretical segment extending between a first end of the second portion and a second end of the first portion;

the second reference theoretical segment extending between a third end, opposite to the first end, of the second portion and a fourth end, opposite to the second end, of the first portion;

the fifth and sixth crease lines and the second and first portions being adapted to bound a front panel of the package, once the packaging material has been folded along the fifth and sixth crease lines and the second and first portions;

the fifth and seventh portions, the fifth crease line, and at least one part of the third crease line being adapted to define a first lateral panel extending from the front panel to the rear panel of the package, once the packaging material has been folded along the fifth crease line, the fifth and seventh portions and the at least one part of the third crease line;

the sixth and eighth portions, the sixth crease line and at least one part of the fourth crease line being adapted to define a second lateral panel extending from the front panel to the rear panel of the package, once the packaging material has been folded along the sixth crease line, the sixth and eighth portions and the at least one part of the fourth crease line;

the fifth crease line being adapted to define a first front lateral edge of the sealed package that bounds the first lateral panel, once the packaging material has been folded along the fifth crease line;

the sixth crease line adapted to define a second front lateral edge of the sealed package that bounds the second lateral panel, once the packaging material has been folded along the sixth crease line;

the fifth and sixth crease lines being separate from one another and being adapted to bound the front panel, extend between the top front edge and the bottom front edge, and be the only edges extending between the top front edge and the bottom front edge, once the packaging material has been folded along the fifth and sixth crease lines; and the sheet packaging material being configured to be formed and sealed into a sterilized tube to produce the sealed package.

29. A sheet packaging material for producing a sealed package of a pourable food product, comprising:

at least one first crease line and one second crease line;

the first crease line comprising a first portion which is adapted to define a top front edge of a top panel of the sealed package;

the second crease line comprising a second portion which is adapted to define a bottom front edge of a bottom panel of the sealed package;

a third crease line which extends between respective third portions of the first and second crease lines;

a fourth crease line which extends between respective fourth portions of the first and second crease lines;

the first crease line further comprising a fifth portion interposed between the first and respective third portions, and a sixth portion interposed between respective the first and fourth portions;

the second crease line further comprising a seventh portion interposed between the second and the respective third portions, and an eighth portion interposed between the second and the respective fourth portions;

the third and fourth crease lines, and the third and fourth portions being adapted to bound a rear panel of the package, once the packaging material has been folded along the third and fourth crease lines, and along the third and fourth portions;

the third and fourth portions of the first crease line being adapted to define a top rear edge of the sealed package;

the third and fourth portions of the second crease line being adapted to define a bottom rear edge of the sealed package;

the distance between the third and between the fourth portions being greater than the distance between the first and second portions, so that the distance between the top rear edge and the bottom rear edge is greater than the distance between the top front edge and the bottom front edge of the sealed package;

a fifth and a sixth crease lines extending, at least partially, within a first area which is bounded by a first and a second reference theoretical segment, and by the first and second portions;

the first reference theoretical segment extending between a first end of the second portion and a second end of the first portion;

the second reference theoretical segment extending between a third end, opposite to the first end, of the second portion and a fourth end, opposite to the second end, of the first portion;

the fifth and sixth crease lines and the second and first portions being adapted to bound a front panel of the package, once the packaging material has been folded along the fifth and sixth crease lines and the second and first portions, the first and second portions defining a theoretical reference plane once the packaging material has been folded along the first and second portions;

the fifth and seventh portions, the fifth crease line, and at least one part of the third crease line being adapted to define a first lateral panel extending from the front panel to the rear panel of the package, once the packaging material has been folded along the fifth crease line, the fifth and seventh portions and the at least one part of the third crease line;

the sixth and eighth portions, the sixth crease line and at least one part of the fourth crease line being adapted to define a second lateral panel extending from the front panel to the rear panel of the package, once the packaging material has been folded along the sixth crease line, the sixth and eighth portions and the at least one part of the fourth crease line;

the fifth and sixth crease lines and the second and first portions being configured so that the front panel bounded by the fifth and sixth crease lines and the second and first portions once the packaging material has been folded along the fifth and sixth crease lines and the second and first portions, is a convex panel curved outwardly of the theoretical reference plane; and the sheet packaging material being configured so that once folding of the sheet packaging material into the sealed package is complete, the sealed package possesses a circumference that is constant at all sections of the sealed package parallel to the bottom panel and located between the top front edge and the bottom front edge.

* * * * *